US007002599B2

(12) United States Patent
Butcher

(10) Patent No.: US 7,002,599 B2
(45) Date of Patent: Feb. 21, 2006

(54) METHOD AND APPARATUS FOR HARDWARE ACCELERATION OF CLIPPING AND GRAPHICAL FILL IN DISPLAY SYSTEMS

(75) Inventor: Lawrence L. Butcher, Mountain View, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 442 days.

(21) Appl. No.: 10/205,781

(22) Filed: Jul. 26, 2002

(65) Prior Publication Data

US 2004/0017381 A1 Jan. 29, 2004

(51) Int. Cl.
*G09G 5/00* (2006.01)

(52) U.S. Cl. ..... 345/619

(58) Field of Classification Search ..... 345/619–628
See application file for complete search history.

(56) References Cited

U.S. PATENT DOCUMENTS 4,783,650 A * 11/1988 Bugg ..... 345/467
4,825,390 A * 4/1989 Van Aken et al. ..... 345/600
5,060,280 A * 10/1991 Mita et al. ..... 382/283
5,214,753 A * 5/1993 Lee et al. ..... 345/610
5,303,334 A * 4/1994 Snyder et al. ..... 358/1.9
5,315,698 A * 5/1994 Case et al. ..... 345/522
5,488,687 A * 1/1996 Rich ..... 345/563
5,515,494 A * 5/1996 Lentz ..... 715/797
5,680,486 A * 10/1997 Mita et al. ..... 382/282
5,805,868 A * 9/1998 Murphy ..... 345/502
5,872,985 A * 2/1999 Kimura ..... 710/1
5,933,105 A * 8/1999 Cho ..... 341/107
5,973,702 A * 10/1999 Orton et al. ..... 345/619
6,005,586 A * 12/1999 Morita et al. ..... 345/624
6,104,359 A * 8/2000 Endres et al. ..... 345/589
6,262,748 B1 * 7/2001 Deering et al. ..... 345/519
6,356,313 B1 * 3/2002 Champion et al. ..... 348/558
6,438,675 B1 * 8/2002 Root et al. ..... 711/217
6,591,020 B1 * 7/2003 Klassen ..... 382/269
2002/0038323 A1 * 3/2002 Hara et al. ..... 707/528
2002/0080280 A1 * 6/2002 Champion et al. ..... 348/584
2002/0188702 A1 * 12/2002 Short et al. ..... 709/220
2003/0043191 A1 * 3/2003 Tinsley et al. ..... 345/762
2003/0184552 A1 * 10/2003 Chadha ..... 345/581
2004/0130552 A1 * 7/2004 Duluk et al. ..... 345/506
2005/0083334 A1 * 4/2005 Noyle ..... 345/506

* cited by examiner

*Primary Examiner*—Michael Razavi
*Assistant Examiner*—Eric Woods
(74) *Attorney, Agent, or Firm*—Martine Penilla and Gencarella LLP

(57) ABSTRACT

Embodiments of the present invention are directed to a method and apparatus for hardware acceleration of clipping and graphical fill in display systems. In one embodiment, all display data is presented to the display system. The display system uses its hardware to clip the undesired data, if necessary, and display the desired data. If a sufficient amount of display data has the same value, the display system uses its hardware to fill the appropriate areas using the shared value. In one embodiment, the display system has one or more accelerating registers. In one embodiment, one or more accelerating registers are fill registers. As display data is read from memory, some of the information's color data is classified by the fill registers. In another embodiment, one or more accelerating registers are clipping registers. As display data arrives from each source, the information's display location is classified by the clipping registers.

7 Claims, 12 Drawing Sheets

METHOD AND APPARATUS FOR HARDWARE ACCELERATION OF CLIPPING AND GRAPHICAL FILL IN DISPLAY SYSTEMS

BACKGROUND OF THE INVENTION

1. Field of the Invention

The present invention relates to the field of computer displays, and in particular to a method and apparatus for hardware acceleration of clipping and graphical fill in display systems.

Sun, Sun Microsystems, the Sun logo, Solaris and Java are trademarks or registered trademarks of Sun Microsystems, Inc. in the United States and other countries.

2. Background Art

In a computer system, a computer may receive data to present to the user using a display device (e.g., a monitor) from multiple sources. For example, a video window with streaming video may be supplied by one source, and a text window may be supplied by another source. The source may be located at the computer attached to the display device, or it may be located at another computer. Typically, in a thin client architecture, no display information source is located at the terminal attached to the display device.

In some instances, the regions of display for two sources may overlap. Display data for the covered portions of the video window must be discarded, or clipped, rather than displayed. In other instances, large regions of the display data contain the same value. For example, a text window with a white background and little or no text, has large regions where the display data value is white. In prior art solutions, software systems are used to clip unneeded display data and to fill same-valued regions. However, software clipping and filling is slow and inefficient. This problem can be better understood with a discussion of display systems in a multi-tier application architecture.

Multi-Tier Application Architecture

In the multi-tier application architecture, a client communicates requests to a server for data, software and services, for example, and the server responds to the requests. The server's response may entail communication with a database management system for the storage and retrieval of data.

The multi-tier architecture includes at least a database tier that includes a database server, an application tier that includes an application server and application logic (i.e., software application programs, functions, etc.), and a client tier. The data base server responds to application requests received from the client. The application server forwards data requests to the database server.

FIG. 1 provides an overview of a multi-tier architecture. Client tier 100 typically consists of a computer system that provides a graphic user interface (GUI) generated by a client 110, such as a browser or other user interface application. Conventional browsers include Internet Explorer and Netscape Navigator, among others. Client 110 generates a display from, for example, a specification of GUI elements (e.g., a file containing input, form, and text elements defined using the Hypertext Markup Language (HTML)) and/or from an applet (i.e., a program such as a program written using the Java™ programming language, or other platform independent programming language, that runs when it is loaded by the browser).

Further application functionality is provided by application logic managed by application server 120 in application tier 130. The apportionment of application functionality between client tier 100 and application tier 130 is dependent upon whether a "thin client" or "thick client" topology is desired. In a thin client topology, the client tier (i.e., the end user's computer) is used primarily to display output and obtain input, while the computing takes place in other tiers (i.e., away from the thin client). A thick client topology, on the other hand, uses a more conventional general purpose computer having processing, memory, and data storage abilities. Database tier 140 contains the data that is accessed by the application logic in application tier 130. Database server 150 manages the data, its structure and the operations that can be performed on the data and/or its structure.

Application server 120 can include applications such as a corporation's scheduling, accounting, personnel and payroll applications, for example. Application server 120 manages requests for the applications that are stored therein. Application server 120 can also manage the storage and dissemination of production versions of application logic. Database server 150 manages the database(s) that manage data for applications. Database server 150 responds to requests to access the scheduling, accounting, personnel and payroll application's data, for example.

Connection 160 is used to transmit data between client tier 100 and application tier 130, and may also be used to transfer the application logic to client tier 100. The client tier can communicate with the application tier via, for example, a Remote Method Invocator (RMI) application programming interface (API) available from Sun Microsystems™. The RMI API provides the ability to invoke methods, or software modules, that reside on another computer system. Parameters are packaged and unpackaged for transmittal to and from the client tier. Connection 170 between application server 120 and database server 150 represents the transmission of requests for data and the responses to such requests from applications that reside in application server 120.

Elements of the client tier, application tier and database tier (e.g., client 110, application server 120 and database server 150) may execute within a single computer. However, in a typical system, elements of the client tier, application tier and database tier may execute within separate computers interconnected over a network such as a LAN (local area network) or WAN (wide area network).

Display Systems

Display systems in the multi-tier application architecture are used to arrange display information for presentation to a user on a display device (e.g., a monitor). Typically, a display system comprises a display memory and a display controller in the client tier 100. The display memory is typically dynamic random access memory (DRAM) and contains pixel color information for each pixel of the display device. The display controller updates the data in the display memory and retrieves data from the display memory to send to the display device.

Frequently, the desired display areas of two display data sources overlap. For example, video data may be transmitted to a client terminal from two different data sources in a thin client architecture and the windows displaying the video data may be overlapping. Since both windows cannot write to the display memory for the overlapping pixels, the video information for the overlapping area of the rear window must be clipped. Furthermore, any portions of the video window which is off the screen must be clipped.

Clipping is typically performed by software. The software saves the desired display data and discards the rest. Then, only the desired display data is passed on to the display system for eventual display. In some systems, the clipping software runs on a different computer from the computer (of the client tier 100) directly attached to the display system.

Typically, thousands, millions or even billions of color value possibilities are available for storage in each display memory location. Frequently, however, the same value is found in many locations. For example, displaying a graphic of a stop sign results in a large number of the display memory locations storing the same value for red. Individually reading and writing each display memory location having the same value is inefficient. In some computer systems, software is used to quickly fill display memory locations with the same value.

Clipping in Thin Client Architectures

In some prior art thin client architecture systems, display data is clipped using software before it is transmitted to the client terminal. However, this approach is difficult and inefficient to coordinate when display data is transmitted from separate source locations. The approach encounters additions problems when display data is being multicast to many client terminals. The clipping may be different for each client terminal receiving the display data, so it is inefficient for the data source to perform clipping before transmitting the data to each client terminal.

SUMMARY OF THE INVENTION

Embodiments of the present invention are directed to a method and apparatus for hardware acceleration of clipping and graphical fill in display systems. In one embodiment of the present invention, all display data is presented to the display system. The display system uses its hardware to clip the undesired data, if necessary, and display the desired data. Additionally, if a sufficient amount of display data has the same value, the display system uses its hardware to fill the appropriate areas using the shared value.

In one embodiment, the display system has one or more accelerating registers. In one embodiment, one or more accelerating registers are fill registers. As display data is read from memory, some of the information's color data is classified by the fill registers. Pixels which have the same value as a value stored in a fill register are read from the fill register rather than from display memory.

In another embodiment, one or more accelerating registers are clipping registers. As display data arrives from each source, the information's display location is classified by the clipping registers. Only pixels which are calculated to be visible by the clipping registers is written to memory for later display.

In one embodiment, the display system has an extra amount of memory, termed "feature memory." In one embodiment, there is a corresponding data location in the feature memory for each pixel in the display memory. Different embodiments have a different number of bits of memory, n, for each data location in the feature memory. As a result, there are two to the nth power different available values which can be stored in each data location. Some values correspond to fill registers containing shared color values. Other values correspond to display contexts. In one embodiment, there are three bits of memory for each data location, resulting in eight possible fill registers and display contexts combined.

In one embodiment, the feature memory is comprised of dynamic random access memory (DRAM).

In one embodiment, a display command is issued to the display system. The command originates from a server. The server is located away from the display system. The server and the display system communicate via a network. The network may comprise a LAN (local area network) or WAN (wide area network). In another embodiment, the display system is located within a thin client. The hardware for clipping and filling is located within the display system.

In one embodiment, commands issued to the display system contain an indicator to indicate either with which fill register the command is associated or within which display context the command should be executed. When a command contains display information for a pixel, the display context for the pixel stored in the feature memory is compared to the indicator of the command. If the display context is equal to the context indicator, the command is executed for the pixel. If the display context is not equal to the context indicator, the display information for the pixel is clipped. In some instances, the entire command may be clipped, and the display memory remains unchanged.

When a command is retrieving display information for a pixel, the value stored in the feature memory for the pixel is examined. In one embodiment, if the value for the pixel in feature memory is equal to a first value, the value stored for the pixel in display memory is retrieved. If the value for the pixel in feature memory is equal to a second value, the value stored in a fill register is retrieved.

In one embodiment, values in feature memory are dynamically allocated as either display context values or fill register values. In one embodiment, each location in feature memory has 3 bits. A maximum of 8 context values are available. Similarly, a maximum of 8 fill registers are available. The number allocated for each function is determined by a feature memory allocator.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

The invention is a method and apparatus for hardware acceleration of clipping and graphical fill in display systems. In the following description, numerous specific details are set forth to provide a more thorough description of embodiments of the invention. It is apparent, however, to one skilled in the art, that the invention may be practiced without these specific details. In other instances, well known features have not been described in detail so as not to obscure the invention.

Hardware Clipping and Filling Acceleration

In one embodiment of the present invention, all display data is presented to the display system. The display system uses its hardware to clip the undesired data, if necessary, and display the desired data. Additionally, if a sufficient amount of display data has the same value, the display system uses its hardware to fill the appropriate areas using the shared value.

In one embodiment, a display command is issued to the display system. The command originates from a server. The server is located away from the display system. The server and the display system communicate via a network. The network may comprise a LAN (local area network) or WAN (wide area network). In another embodiment, the display system is located within a thin client. The hardware for clipping and filling is located within the display system.

Fill Registers

In one embodiment, the display system has one or more accelerating registers. In one embodiment, one or more accelerating registers are fill registers. As display data is read from memory, some of the information's color data is classified by the fill registers. Pixels which have the same value as a value stored in a fill register are read from the fill register rather than from display memory.

Figure 1:
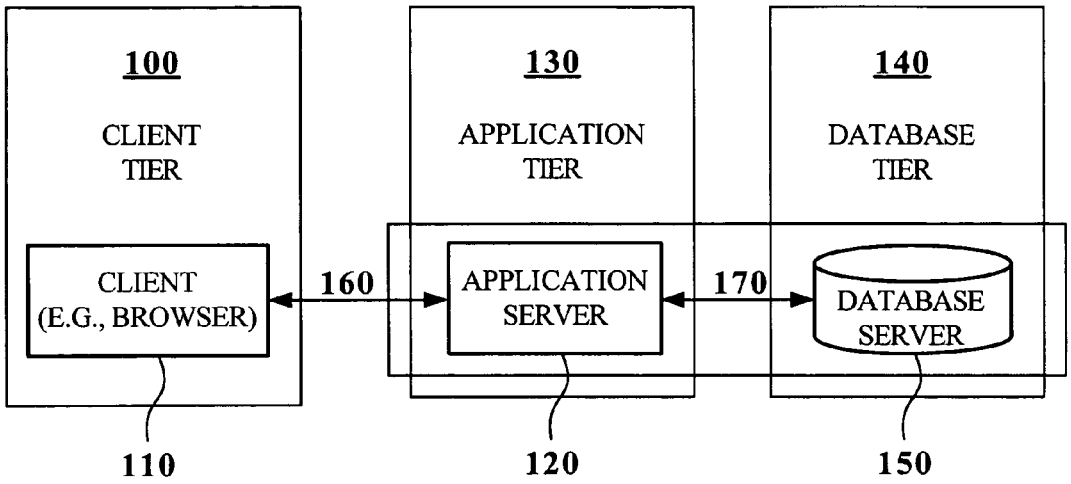
FIG. 1 is a block diagram of a multi-tier architecture.
Figure 2:
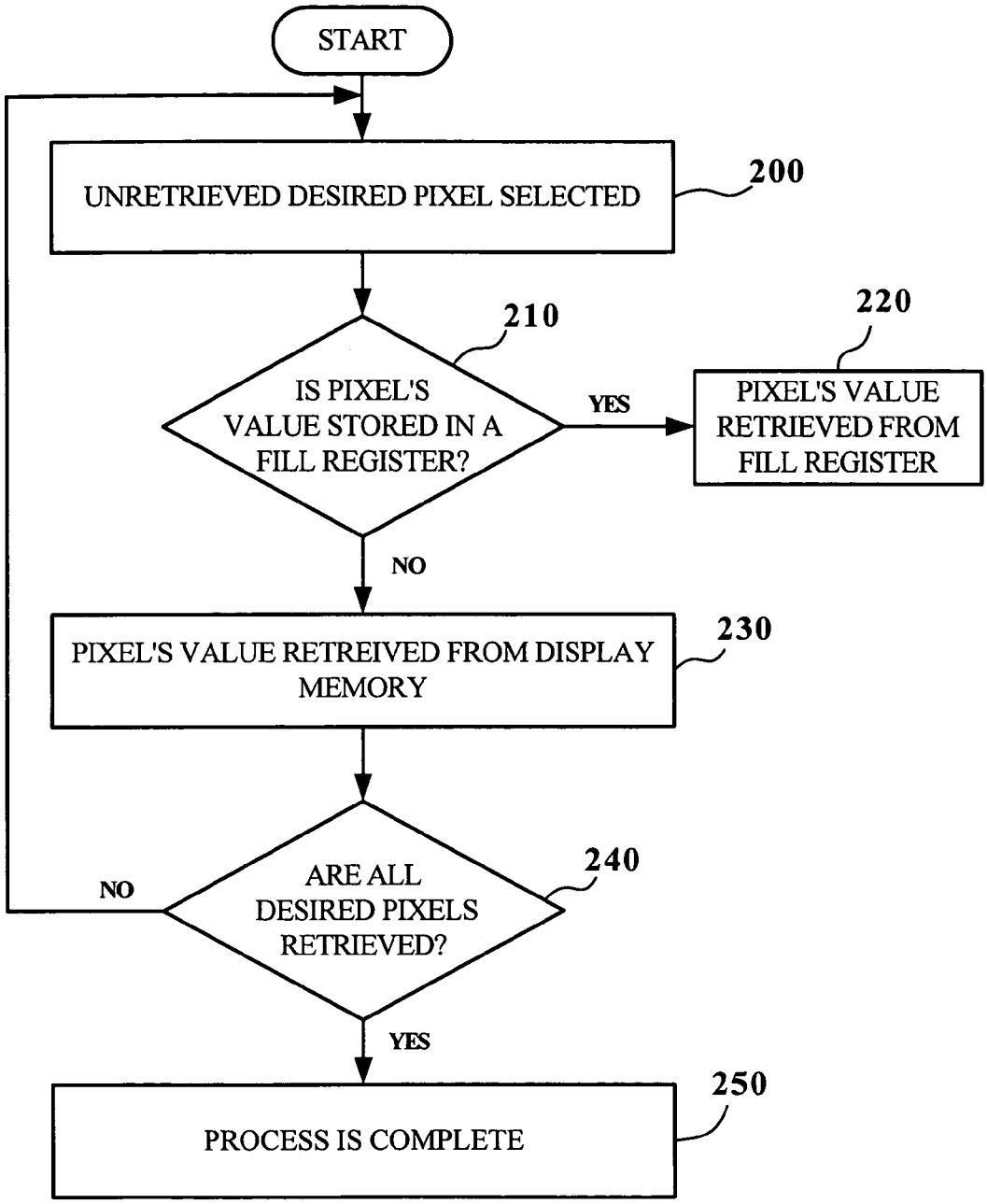
FIG. 2 is a flow diagram of the process of retrieving display information in accordance with the present invention.

FIG. 2 illustrates the process of retrieving display information in accordance with the present invention. At block 200, an unretrieved desired pixel is selected. At block 210, it is determined whether the pixel's value is stored in a fill register. If the pixel's value is stored in a fill register, at block 220, the pixel's value is retrieved from a fill register and the process continues at block 240. If the pixel's value is not stored in a fill register, at block 230, the pixel's value is retrieved from display memory and the process continues at block 240.

At block 240, it is determined whether all desired pixels have been retrieved. If all desired pixels have been retrieved, at block 250, the process is complete. If not all desired pixels have been retrieved, the process repeats at step 200.

Clipping Registers

In another embodiment, one or more accelerating registers are clipping registers. As display data arrives from each source, the information's display location is classified by the clipping registers. Only pixels which are calculated to be visible by the clipping registers is written to memory for later display.

Figure 3:
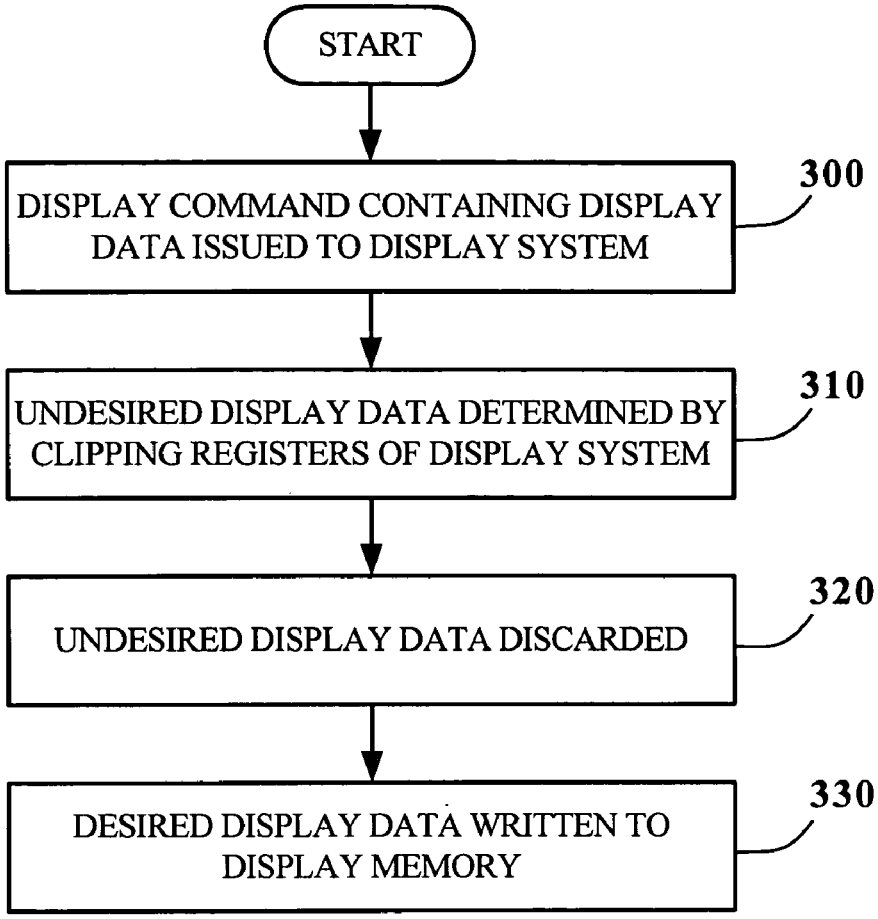
FIG. 3 is a flow diagram of the process of display data clipping using clipping registers in accordance with one embodiment of the present invention.

FIG. 3 illustrates the process of display data clipping using clipping registers in accordance with one embodiment of the present invention. At block 300, a display command containing display data is issued to the display system. At block 310, the undesired display data is determined by the clipping registers of the display system. At block 320, the undesired display data is discarded. At block 330, the desired display data is written to the display memory.

Feature Memory

In one embodiment, the display system has an extra amount of memory, termed "feature memory." In one embodiment, there is a corresponding data location in the feature memory for each pixel in the display memory.

In one embodiment, the feature memory is comprised of dynamic random access memory (DRAM).

Figure 4:
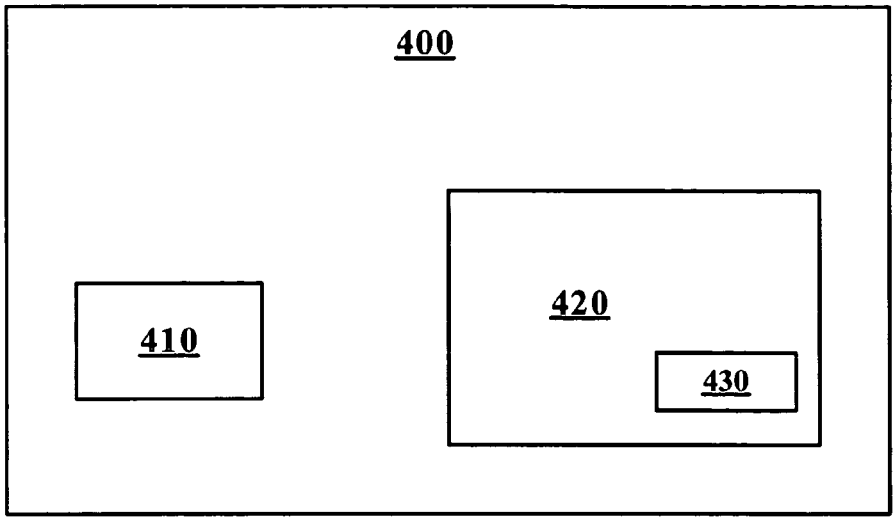
FIG. 4 is a block diagram of a display system in accordance with one embodiment of the present invention.

FIG. 4 illustrates a display system in accordance with one embodiment of the present invention. The display system 400 has a display memory 410 coupled to a graphics processor chip 420. The graphics processor chip has a feature memory 430. Having the feature memory on the graphics processor chip allows the graphics processor chip to quickly access the display mask memory at the same time it accesses the display memory. In another embodiment, the feature memory is contained on a separate memory chip. In still another embodiment, the feature memory is a defined region of the display memory.

Different embodiments have a different number of bits of memory, n, for each data location in the feature memory. As a result, there are two to the nth power different available values which can be stored in each data location. Some values correspond to fill registers containing shared color values. Other values correspond to display contexts. In one embodiment, there are three bits of memory for each data location, resulting in eight possible fill registers and display contexts combined.

Figure 5:
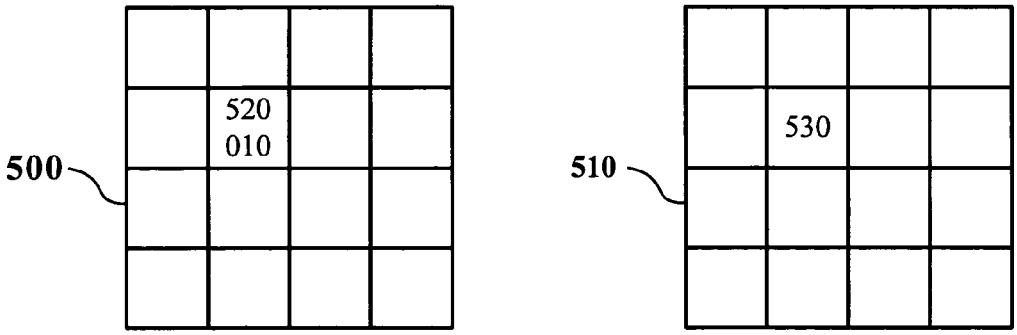
FIG. 5 is a block diagram of a feature memory in accordance with one embodiment of the present invention.

FIG. 5 illustrates a feature memory in accordance with one embodiment of the present invention. The feature memory 500 has 16 data locations that correspond to the 16 pixels in the display memory 510. Data location 520 corresponds to pixel 530. Each data location of the feature memory has 3 bits of memory. If each location in display memory has 24 bits of color information, the feature memory is significantly smaller than the display memory. The three bits of storage for data location 520 are 010. Thus, 010 is either the display context for pixel 530 or 010 is the fill register which contains the correct color value for pixel 530.

Write Commands

Before a command writing data to the display memory is executed for pixel 530, it is determined whether the display context of a command is also 010. If the display context of the command is not 010, the command is not executed. For example, if two video windows overlap at pixel 530, both will send display data to the display system for pixel 530. However, the display data for pixel 530 should be clipped for at least one of the video windows. If another window also overlaps pixel 530, it may be the case that the display data for pixel 530 from both video windows should be clipped. Only one of the sets of display data that overlap at pixel 530 will have display context 010. Thus, only display data with a display context of 010 is written to the pixel and the competing display data is clipped.

In one embodiment, commands issued to the display system contain an indicator to indicate either with which fill register the command is associated or within which display context the command should be executed. When a command contains display information for a pixel, the display context for the pixel stored in the feature memory is compared to the context indicator of the command. If the display context is equal to the context indicator, the command is executed for the pixel. If the display context is not equal to the context indicator, the display information for the pixel is clipped. In some instances, the entire command may be clipped, and the display memory remains unchanged.

Figure 6:
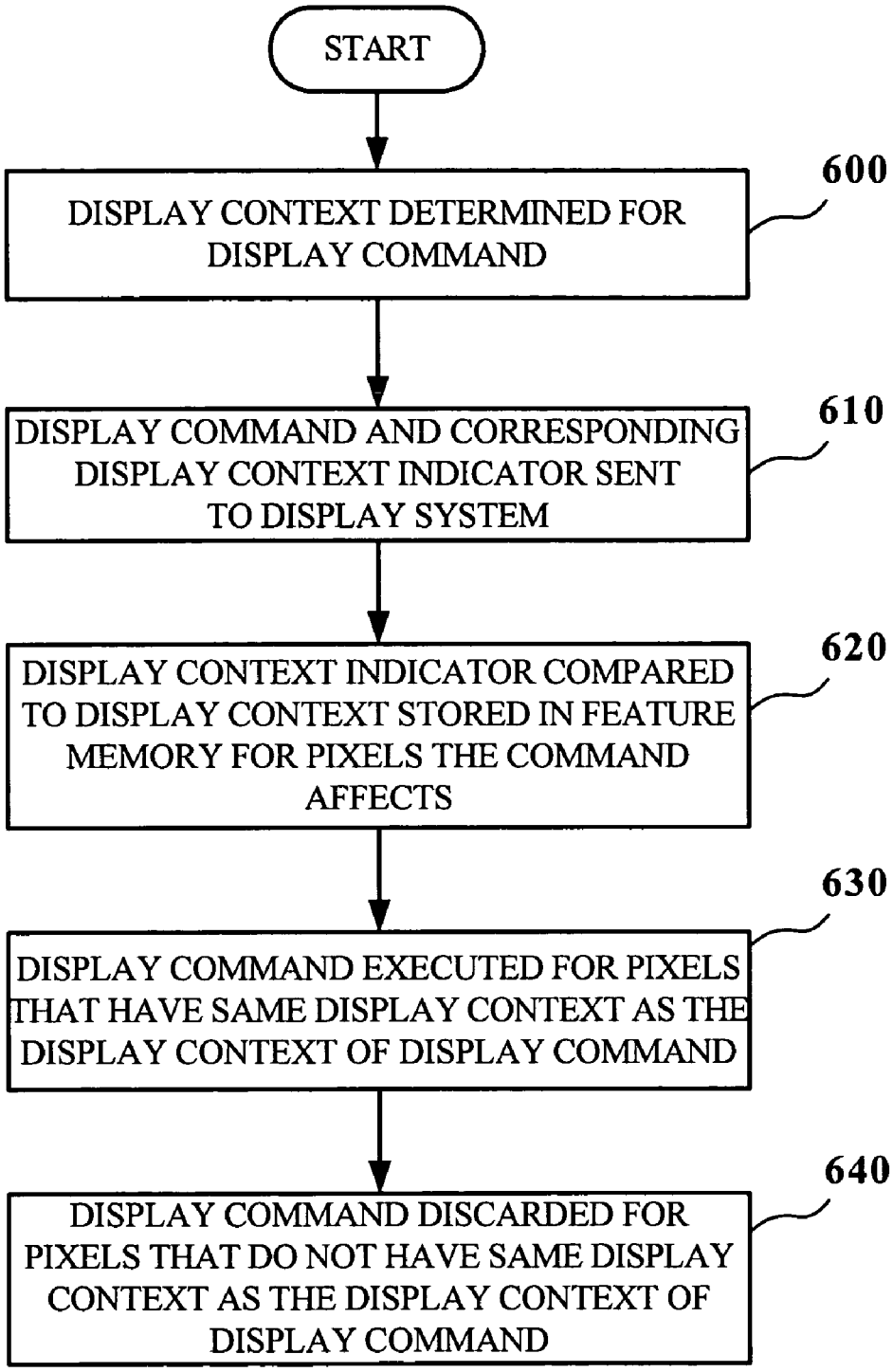
FIG. 6 is a flow diagram of the execution of display commands in accordance with one embodiment of the present invention.

FIG. 6 illustrates the execution of display commands in accordance with one embodiment of the present invention. At block 600, a display context is determined for a display command. At block 610, the display command and a corresponding display context indicator are sent to the display system. At block 620, the display context indicator is compared to the display context stored in the data locations of the feature memory that correspond to the pixels the command affects.

At block 630, the display command is executed for pixels that have the same display context stored in their corresponding feature memory locations as the display context of the display command. At block 640, the display command is discarded for pixels that do not have the same display context stored in their corresponding feature memory locations as the display context of the display command.

Read Commands

In one embodiment, when a command is retrieving display information for a pixel, the value stored in the feature memory for the pixel is examined. If the value stored in the feature memory indicates that the pixel has a value equal to a shared value stored in a fill register, the value stored in a fill register is retrieved. Otherwise, the value stored for the pixel in display memory is retrieved.

For example, when a command reading data for pixel 530 is executed for pixel, it is determined whether the value stored in feature memory for pixel 530, 010, is associated with a fill register. If 010 is associated with a fill register, the value in the fill register is retrieved for the pixel. Otherwise, the value stored for pixel 530 in display memory is retrieved.

Figure 7:
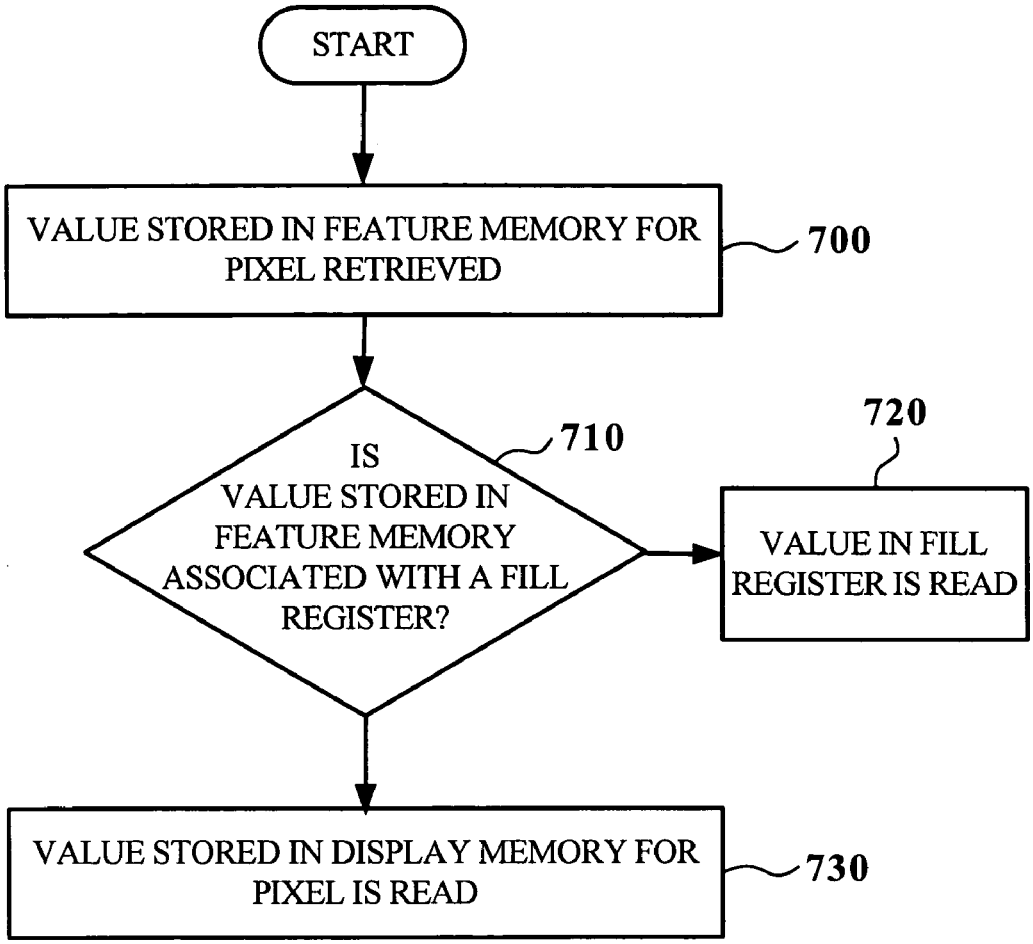
FIG. 7 is a flow diagram of the process of executing read commands in accordance with one embodiment of the present invention.

FIG. 7 illustrates the process of executing read commands in accordance with one embodiment of the present invention. At block 700, the value stored in the feature memory location associated with a pixel is retrieved. At block 710, it is determined whether the value stored in feature memory is associated with a fill register. If the value stored in feature memory is associated with a fill register, at block 720, the value in the fill register is read. If the value stored in feature memory is not associated with a fill register, at block 730, the value stored in display memory for the pixel is read.

Dynamic Allocation of Contexts and Fill Registers

In one embodiment, values in feature memory are dynamically allocated as either display context values or fill register values. In one embodiment, each location in feature memory has 3 bits. A maximum of 8 context values are available. Similarly, a maximum of 8 fill registers are available. The number of 3-bit code combinations allocated for each function is determined by a feature memory allocator.

Figure 8:
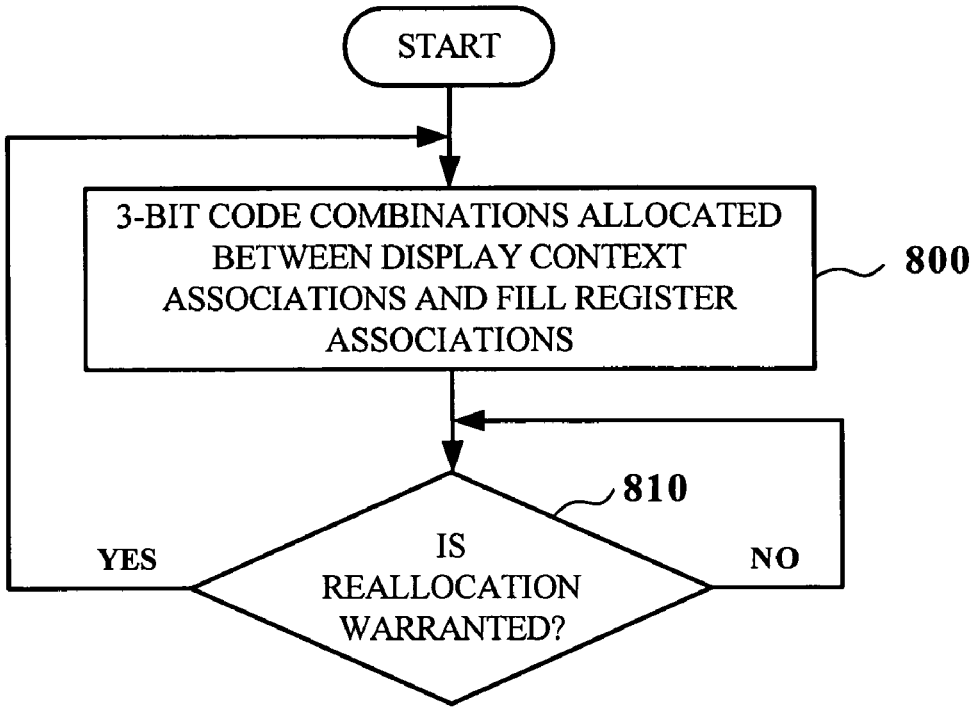
FIG. 8 is a flow diagram of the operation of a display system in accordance with one embodiment of the present invention.

FIG. 8 illustrates the operation of a display system in accordance with one embodiment of the present invention. The display system has a feature memory with 3 bits of storage for each storage location, but other embodiments have display systems with feature memories having other numbers of bits of storage for each storage location. At block 800, the 3-bit code combinations are allocated between display context associations and fill register associations. At block 810, it is determined whether reallocation is warranted. If reallocation is warranted, the process repeats at block 800. If reallocation is not warranted, the process repeats at step 810.

Typically, allocation of the n-bit code combinations depends upon the number of video streams from different sources and the number of different colored display sources containing large amounts of the same color (e.g., text windows with different background colors). For example, in a display system which is used to display a singe video stream and many text windows from the same source, it is desirable to maximize the number of fill registers. The 3-bit code for 0 (000) is allocated to represent reading data directly from display memory.

Similarly, the 3-bit codes for 1 through 7 (respectively, 001, 010, 100, 011, 110, 101, 111) are each associated with a different fill register. The most commonly occurring seven colors are stored in the seven fill registers. When a different color becomes more commonly occurring than a color stored in the fill registers, the color replaces the color in the fill registers. The values in the feature memory are updated to reflect the change in colors stored in the fill registers.

In one embodiment, algorithms are employed to increase the stability of the colors stored in the fill register. In an example embodiment, a color must be more commonly occurring than a color stored in the fill registers for a period of time before it replaces the color in the fill registers. In another example embodiment, a color must be more commonly occurring than some threshold value of colors stored in the fill registers.

As the display needs of display system change, the allocation of the n-bit code combinations can also change. In the example above of the display system used to display a singe video stream and many text windows from the same source, if the system is changed to display eight video streams, each from a different source, the 3-bit code combinations are reallocated. Each code combination is allocated to the display context of a different video stream. Thus, there are no longer any fill registers in use.

Similarly, if the display system above is used to display three video streams from different sources and several text windows from another source, the 3-bit code combinations are reallocated. 0 may indicate that data should be displayed directly from display data while 1 through 4 are associated with four different fill registers and 5 through 7 are associated with different display contexts.

Fill Registers as Part of Display Context

In one embodiment, more than one n-bit code combination is allocated to a display context. One of the n-bit code combinations allocated to the context is used to indicate that display data should be read directly from the display memory. Other n-bit code combinations allocated to the context indicate that display data should be read from certain fill registers rather than from the display memory. Also, write commands which have any of the n-bit code combinations allocated to the context are executed for pixels having the same context.

For example, in one embodiment, a display system is used to display data from four different sources. Two sources, Source 1 and Source 2, provide display data (e.g., text windows with different background colors) that have large numbers of pixels sharing the same colors. Two more sources, Source 3 and Source 4, provide display data in which not many pixels share the same color values.

The feature memory of the display system has 3 bits of memory for each data location. Values 0, 1 and 2 are all allocated to the display context for Source 1. Only write commands having a context indicator of 0, 1 or 2 will be executed for pixels that have a 0, 1 or 2 stored in their corresponding feature memory location. Additionally, value 0 indicates that display data should be read from the display memory directly, value 1 indicates that display data should be read from fill register 1 and value 2 indicates that display data should be read from fill register 2.

Similarly, values 3, 4 and 5 are all allocated to the display context for Source 2. Only write commands having a context indicator of 3, 4 or 5 will be executed for pixels that have a 3, 4 or 5 stored in their corresponding feature memory location. Additionally, value 3 indicates that display data should be read from the display memory directly, value 4 indicates that display data should be read from fill register 3 and value 5 indicates that display data should be read from fill register 4.

Value 6 is allocated to the display context for Source 3. Only write commands having context 6 will be executed for pixels that have 6 stored in their corresponding feature memory location. Additionally, when a pixel having a 6 stored in its corresponding feature memory location is read, the data is read directly from display memory.

Finally, value 7 is allocated to the display context for Source 4. Only write commands having context 7 will be executed for pixels that have 7 stored in their corresponding feature memory location. Additionally, when a pixel having a 7 stored in its corresponding feature memory location is read, the data is read directly from display memory.

Figure 9:
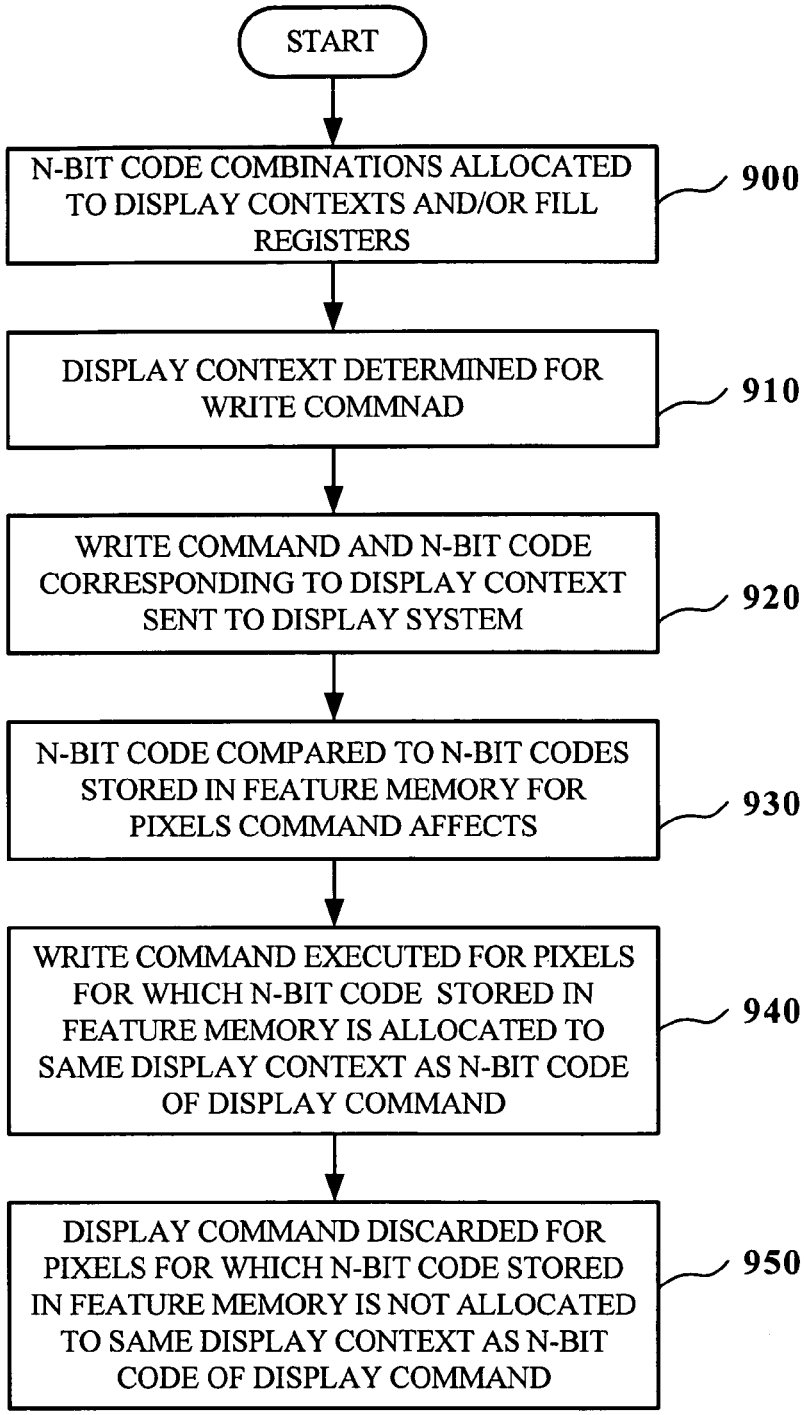
FIG. 9 is a flow diagram of the process of executing write commands in accordance with one embodiment of the present invention.

FIG. 9 illustrates the process of executing write commands in accordance with one embodiment of the present invention. At 900, n-bit code combinations are allocated to display contexts and/or fill registers. At block 910, a display context is determined for a write command. At block 920, the write command and an n-bit code corresponding to the display context are sent to the display system. At block 930, the n-bit code is compared to the n-bit codes stored in the data locations of the feature memory that correspond to the pixels the command affects.

At block 940, the write command is executed for pixels for which the n-bit code stored in their corresponding feature memory locations is allocated to the same display context as the n-bit code of the display command. At block 950, the display command is discarded for pixels for which the n-bit code stored in their corresponding feature memory locations is not allocated to the same display context as the n-bit code of the display command.

Virtual Desktop System Architecture

Figure 10:
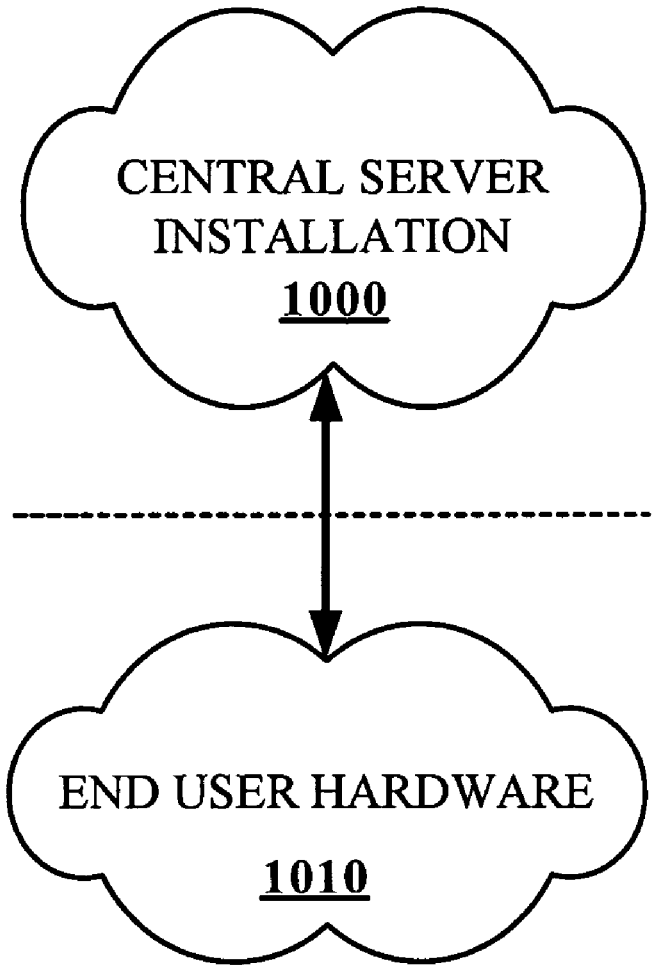
FIG. 10 is a block diagram of an example of a thin client topology called a virtual desktop system architecture in accordance with one embodiment of the present invention.

One embodiment of the invention is used as part of a thin client architecture system. FIG. 10 shows an example of a thin client topology called a virtual desktop system architecture. The virtual desktop system architecture provides a re-partitioning of functionality between a central server installation 1000 and end user hardware 1010. Data and computational functionality are provided by data sources via a centralized processing arrangement. At the user end, all functionality is eliminated except that which generates output to the user (e.g., display and speakers), takes input from the user (e.g., mouse and keyboard) or other peripherals that the user may interact with (e.g., scanners, cameras, removable storage, etc.). All computing is done by the central data source and the computing is done independently of the destination of the data being generated. The output of the source is provided to a terminal, referred to here as a "Human Interface Device" (HID). The HID is capable of receiving the data and displaying the data.

Figure 11:
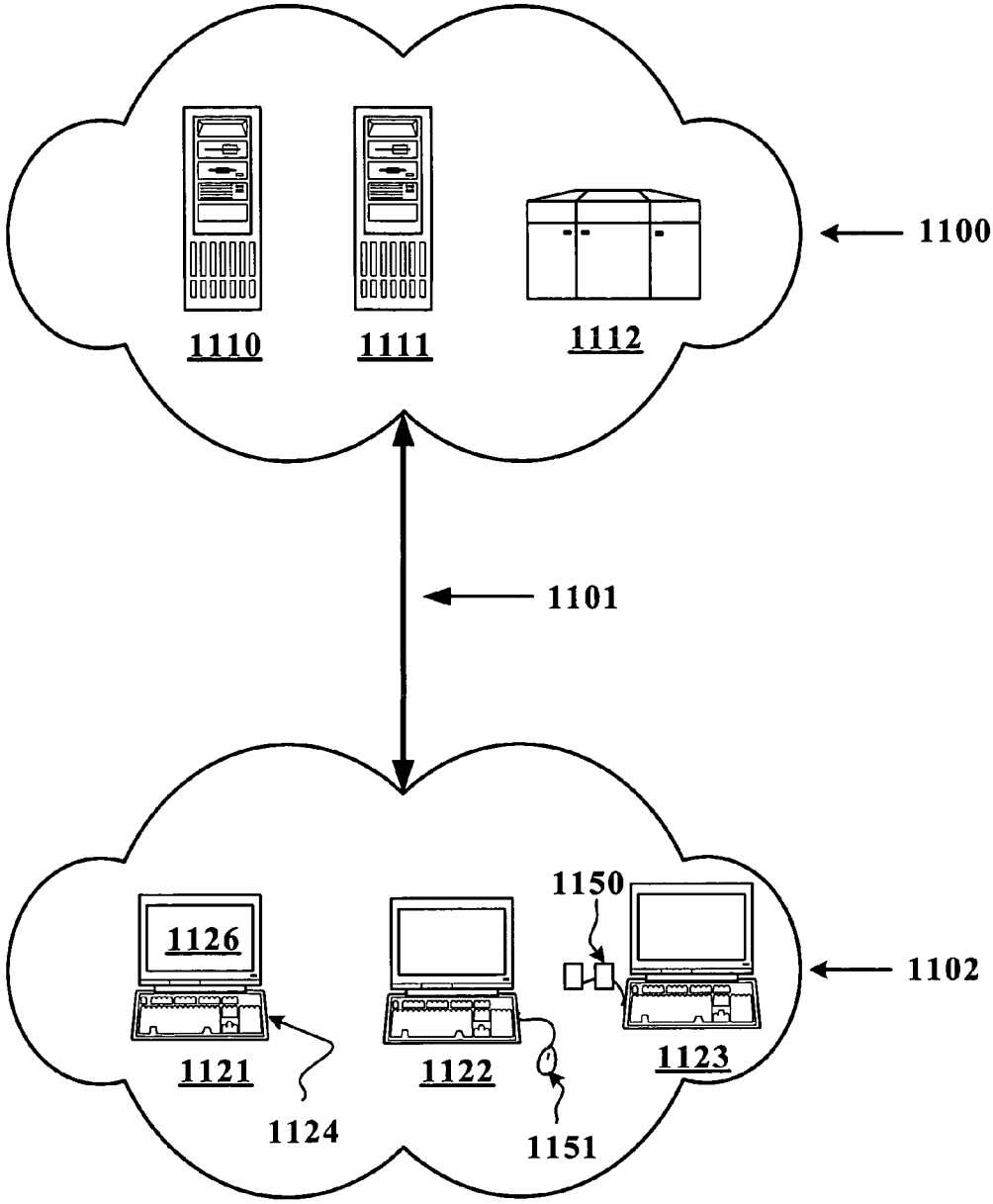
FIG. 11 is a block diagram of a system wherein one or more services communicate with one or more HIDs through a communication link such as network in accordance with one embodiment of the present invention.

The functionality of the virtual desktop system is partitioned between a display and input device such as a remote system and associated display device, and data sources or services such as a host system interconnected to the remote system via a communication link. The display and input device is a human interface device (HID). The system is partitioned such that state and computation functions have been removed from the HID and reside on data sources or services. One or more services communicate with one or more HIDs through a communication link such as network. An example of such a system is illustrated in FIG. 11, wherein the system comprises computational service providers 1100 communicating data through communication link 1101 to HIDs 1102.

The computational power and state maintenance are provided by the service providers or services. The services are not tied to a specific computer, but may be distributed over one or more traditional desktop systems such as described in connection with FIG. 11, or with traditional servers. One computer may have one or more services, or a service may be implemented by one or more computers. The service provides computation, state and data to HIDs and the service is under the control of a common authority or manager. In FIG. 11, the services are provided by computers 1110, 1111, and 1112. In addition to the services, a central data source can provide data to the HIDs from an external source such as for example the Internet or world wide web. The data source can also be broadcast entities such as those that broadcast data (e.g., television and radio signals).

Examples of services include X11/Unix services, archived or live audio or video services, Windows NT service, Java™ program execution service and others. A service herein is a process that provides output data and response to user requests and input. The service handles communication with an HID currently used by a user to access the service. This includes taking the output from the computational service and converting it to a standard protocol for the HID. The data protocol conversion is handled by a middleware layer, such as the X11 server, the Microsoft Windows interface, video format transcoder, the OpenGL® interface, or a variant of the java.awt.graphics class within the service producer machine. The service machine handles the translation to and from a virtual desktop architecture wire protocol described further below.

Each service is provided by a computing device optimized for its performance. For example, an Enterprise class machine could be used to provide X11/Unix service, a SunMediaCenter™ could be used to provide video service, a Hydra based NT machine could provide applet program execution services.

The service providing computer system can connect directly to the HIDs through the interconnect fabric. It is also possible for the service producer to be a proxy for another device providing the computational service, such as a database computer in a three-tier architecture, where the proxy computer might only generate queries and execute user interface code.

The interconnect fabric can comprise any of multiple suitable communication paths for carrying data between the services and the HIDs. In one embodiment the interconnect fabric is a local area network implemented as an Ethernet network. Any other local network may also be utilized. The invention also contemplates the use of wide area networks, the Internet, the world wide web, and others. The interconnect fabric may be implemented with a physical medium such as a wire or fiber optic cable, or it may be implemented in a wireless environment.

The interconnect fabric provides actively managed, low-latency, high-bandwidth communication between the HID and the services being accessed. One embodiment contemplates a single-level, switched network, with cooperative (as opposed to completing) network traffic. Dedicated or shared communications interconnects maybe used in the present invention.

The HID is the means by which users access the computational services provided by the services. FIG. 11 illustrates HIDs 1121, 1122 and 1123. Each HID comprises a display 1126, a keyboard 1124, mouse 1151, and audio speakers 1150. The HID includes the electronics need to interface these devices to the interconnection fabric and to transmit to and receive data from the services.

Figure 12:
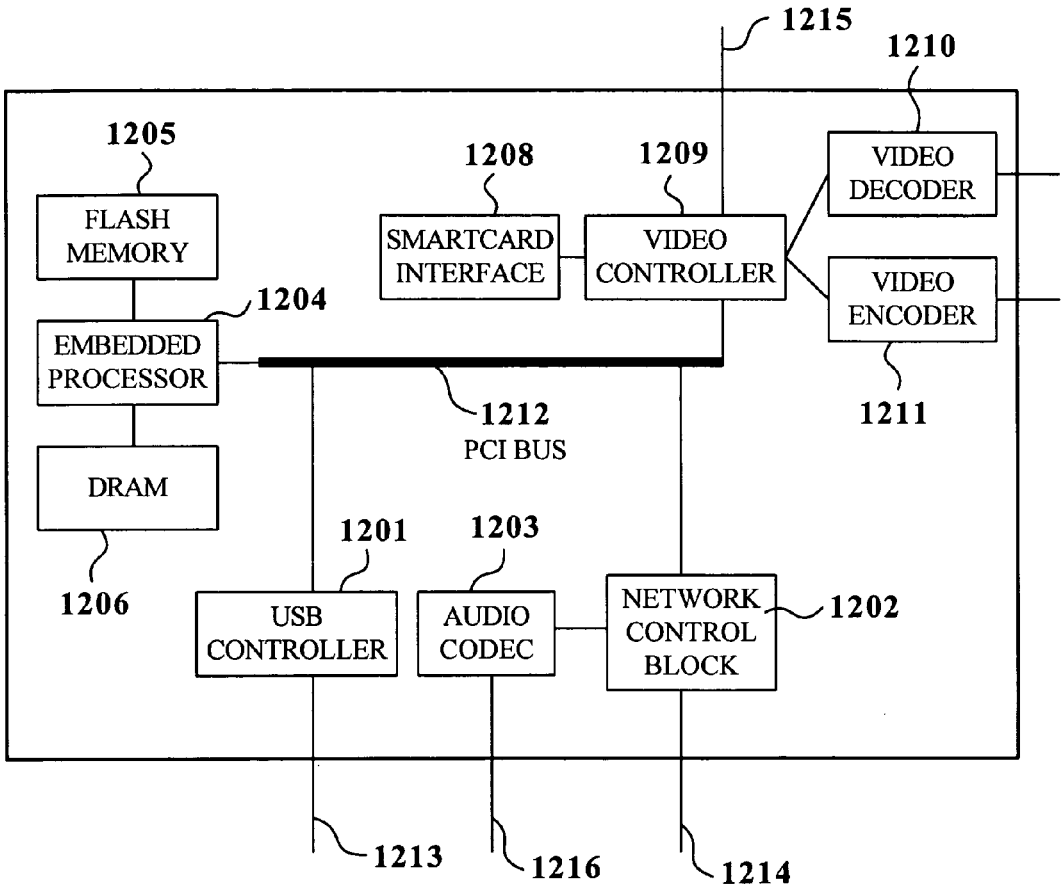
FIG. 12 is a block diagram of an example embodiment of the HID in accordance with one embodiment of the present invention.

A block diagram of an example embodiment of the HID is illustrated in FIG. 12. The components of the HID are coupled internally to a PCI bus 1212. Network control block 1202 communicates to the interconnect fabric, such as an Ethernet, through line 1214. An audio codec 1203 receives audio data on interface 1216 and is coupled to network control block 1202. USB data communication is provided on lines 1213 to a USB controller 1201. The HID further comprises a embedded processor 1204 such as a Sparc2ep with coupled flash memory 1205 and DRAM 1206. The USB controller 1201, the network control block 1202 and the embedded processor 1204 are all coupled to the PCI bus 1212. A video controller 1209, also coupled to the PCI bus 1212, can include an ATI RagePro+ frame buffer controller which provides SVGA output on the line 1215. NTSC data is provided in and out of the video controller through video decoder 1210 and encoder 1211 respectively. A smartcard interface 1208 may also be coupled to the video controller 1209.

Figure 13:
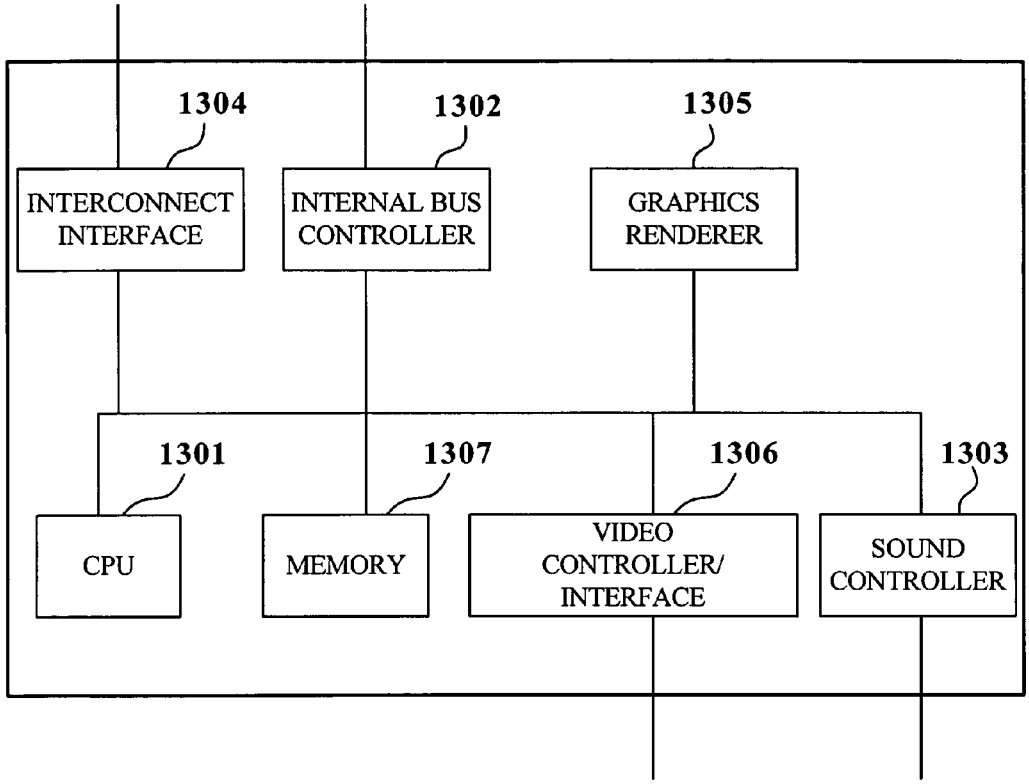
FIG. 13 is a block diagram of a single chip implementation of an HID in accordance with one embodiment of the present invention.

Alternatively, the HID can comprise a single chip implementation as illustrated in FIG. 13. The single chip includes the necessary processing capability implemented via CPU 1301 and graphics renderer 1305. Chip memory 1307 is provided, along with video controller/interface 1306. A internal bus (USB) controller 1302 is provided to permit communication to a mouse, keyboard and other local devices attached to the HID. A sound controller 1303 and interconnect interface 1304 are also provided. The video interface shares memory 1307 with the CPU 1301 and graphics renderer 1305. The software used in this embodiment may reside locally in on-volatile memory or it can be loaded through the interconnection interface when the device is powered.

Thus, a method and apparatus for hardware acceleration of clipping and graphical fill in display systems is described in conjunction with one or more specific embodiments. The invention is defined by the following claims and their full scope and equivalents.

What is claimed is:

1. A computer-implemented method of displaying display data comprising:

receiving a display command, the display command being associated with one of a plurality of contexts;

retrieving a bit code from a location in a feature memory corresponding to a location in a display memory identified by the display command, the display memory containing a value corresponding to a color for each pixel in an array of pixels for a display;

when the display command is a write command for writing data to the display memory, preventing the writing to the display memory when the bit code is allocated to a context that does not match a context of the write command;

when the display command is a read command, reading a value from a fill register when the bit code is associated with the fill register and reading a value from the location in the display memory when the bit code is not associated with any fill register; and dynamically allocating a plurality of bit codes to one of the plurality of contexts, wherein one of the plurality of bit codes is not associated with any fill register and at least one other of the plurality of bit codes is associated with a corresponding fill register.

2. The method of claim 1, further comprising:

storing a common color value in said fill register, the common color value being selected based on how commonly a color corresponding to the common color value occurs in the array of pixels.

3. The method of claim 1, wherein said display command originates from a remote server.

4. The method of claim 3, wherein said remote server communicates said display command via a network.

5. A display system comprising:

a display memory, the display memory containing a plurality of display memory locations wherein each of the plurality of display memory locations contain color information for a corresponding pixel in an array of pixels to be displayed;

a feature memory, the feature memory containing a plurality of feature memory locations wherein each of the plurality of feature memory locations contain a bit code for a corresponding one of the display memory locations;

a graphics processor in communication with the display memory and the feature memory, the graphics processor configured to read from an identified location in the display memory in response to receiving a read command and write to an identified location in the display memory in response to receiving a write command, wherein:

when the graphics processor receives a write command, the graphics processor is prevented from writing to the identified location in the display memory when the bit code in a corresponding location in the feature memory is allocated to a context that does not match a context of the write command, the context of the write command being one of a plurality of contexts; and when the graphics processor receives a read command, the graphics processor reads a value from the identified location in the display memory when the bit code stored in a corresponding location in the feature memory is not associated with any fill register and reads a value from an associated fill register when the bit code in the corresponding location in the feature memory is associated with the associated fill register; and wherein the display system dynamically allocates a plurality of bit codes to one of the plurality of contexts, wherein one of the plurality of bit codes is not associated with any fill register and at least one other of the plurality of bit codes is associated with a corresponding fill register.

6. The display system of claim 5 wherein the graphics processor comprises an integrated circuit and the feature memory is located on the integrated circuit.

7. The display system of claim 5 wherein the associated fill register contains a common color value, the common color value being selected based on how commonly a color corresponding to the common color value occurs in the array of pixels.

* * * * *